US005232057A

United States Patent [19]

Renard

[11] Patent Number: 5,232,057

[45] Date of Patent: Aug. 3, 1993

[54] SINGLE LEVER MULTIPLE FUNCTION CONTROL MECHANISM

[75] Inventor: Mark A. Renard, Hatley, Wis.

[73] Assignee: Case Corporation, Racine, Wis.

[21] Appl. No.: 997,112

[22] Filed: Dec. 24, 1992

Related U.S. Application Data

[63] Continuation of Ser. No. 739,265, Aug. 1, 1991, abandoned.

[51] Int. Cl.[5] ..... E02F 3/85; G05G 9/047

[52] U.S. Cl. ..... 172/812; 74/471 XY; 137/636.2; 137/636.3; 172/828

[58] Field of Search ..... 172/812, 810, 811, 818, 172/819, 828; 74/471 KY; 137/636.3, 636.2; 414/694, 4; 244/234; 37/DIG. 10; 180/333

[56] References Cited

U.S. PATENT DOCUMENTS

| | | | |
|---|---|---|---|
| 3,131,574 | 5/1964 | Clingerman | 137/636.3 |
| 3,321,990 | 5/1967 | Densmore | 74/471 XY |
| 3,891,042 | 6/1975 | Braun | 74/471 XY |
| 4,019,401 | 4/1977 | Drone | 74/471 XY |
| 4,028,958 | 6/1977 | Schuermann et al. | 74/471 XY |
| 4,041,976 | 8/1977 | Brownell | 137/636.2 |
| 4,187,737 | 2/1980 | Mori et al. | 74/471 XY |
| 4,216,467 | 8/1980 | Colston | 414/4 |
| 4,283,964 | 8/1981 | Grattapaglia | 137/636.2 |
| 4,938,091 | 7/1990 | Waggoner et al. | 74/471 XY |
| 4,978,273 | 12/1990 | Radke et al. | 74/471 XY |
| 5,002,454 | 3/1991 | Hadank et al. | 74/471 XY |
| 5,056,985 | 10/1991 | Johnson et al. | 414/694 |
| 5,110,253 | 5/1992 | Ernst et al. | 414/694 |
| 5,112,184 | 5/1992 | Tapper et al. | 74/471 X |
| 5,140,865 | 8/1992 | Foster | 137/636.2 |

*Primary Examiner*—Dennis L. Taylor
*Assistant Examiner*—Spencer Warnick
*Attorney, Agent, or Firm*—Jansson & Shupe, Ltd.

[57] ABSTRACT

A control mechanism for actuating multiple valve spools with a single control lever includes a frame member to which a valve assembly having multiple valve spools is assembled. A fixed shaft is mounted in a spaced parallel relationship to said valve spools, with a plurality of motion transfer devices mounted to the fixed shaft which are connected at one end to the valve spools. The other ends of the motion transfer devices are connected to an adapter which is mounted to a spherical pivot in such a way that only one of the valve spools is operated when the lever is reciprocated in a first control direction, only one other valve spool is operated when the lever is reciprocated in a second control direction, and only another valve spool is operated when the lever is twisted up to a predetermined amount. The first, second and third valve spools can be operated one at a time, two at a time or all at once. Additionally, the control mechanism provides for additional motion transfer devices and valve spools to be mounted for operation by auxiliary levers to conveniently provide for additional functions.

7 Claims, 4 Drawing Sheets

SINGLE LEVER MULTIPLE FUNCTION CONTROL MECHANISM

RELATED APPLICATION

This application is a continuation of application Ser. No. 07/739,265 filed Aug. 1, 1991, and now abandoned.

BACKGROUND OF THE INVENTION

1. Field of the Invention

The present invention relates to heavy construction equipment and apparatus. More particularly the invention relates to crawler dozers, and an improved control apparatus for controlling the positioning of the blade of the crawler dozer.

2. Description of the Prior Art

At the present time, most crawler dozer blades are controlled by two levers, one moves in a fore and aft direction, and the other moves fore and aft and side to side. One lever controls both the lift and the tilt of the blade, while the second lever controls the angle of the blade. The lift and tilt lever motion simulates the blades' motion, but the angle lever does not simulate the angling of the blade. Because of the extra lever, the angling of the blade takes extra time for the operator of the crawler dozer to master. It also causes the operator to switch levers for the different functions.

Therefore, there has been a continuing search in the art to find a way to provide a single control lever to perform the three functions, lift, tilt and angle, and to provide for simulation with respect to each of these and particularly the angling function. Since the blade of the crawler dozer requires a minimum of three valve spools to perform the three functions, the single lever will have to control each of them. One valve spool will be needed for the lift/lower function of the blade. Another valve spool will be needed to tilt the blade with respect to a horizontal reference plane. A third valve spool will be needed to control the angle of the blade with respect to the longitudinal axis of the construction vehicle. Preferably, reciprocating the control lever back and forth in a first control direction will control the lift and lower function; reciprocating the lever left and right in a second, orthogonal, control direction will control the tilt; and twisting the control lever will simulate the change in angle of the crawler dozer blade.

Also, there is often the need to control additional functions in construction equipment. Controlling these functions requires auxillary valve spools and extra control levers. Along with the search in the art to find a way to provide a single control lever to perform the lift, tilt and angle functions of the crawler dozer blade, there has been a search directed to finding such a control mechanism to which auxillary control levers and valve spools may be added at a minimum of expense.

One attempt to control three functions with a single lever control mechanism has resulted in U.S. Pat. No. 4,938,091, issued Jul. 3, 1990, to Waggoner, et al. However, such mechanism is exceedingly complicated, is not believed to provide the simulation of the angle of the crawler dozer blade, and does not provide for the addition of auxiliary spools and levers to the control mechanism for controlling other functions as desired.

Another attempt at solving certain problems in the art has resulted in the issue of U.S. Pat. No. 4,041,976 to Roy D. Brownell on Aug. 16, 1977. The Brownell device again shows a single control lever operating three valve spools, but two of the valve spools must be operated simultaneously, and a twisting of the lever to provide control of the blade angle is not provided for. Thus, those skilled in the art have continued their search for a satisfactory single lever control mechanism which will provide for the lift and lower, tilt, and angle functions of crawler dozer blades, or perform similar functions in other construction equipment.

SUMMARY OF THE PRESENT INVENTION

In accordance with the present invention there is provided an apparatus having a single lever for controlling multiple functions in heavy construction equipment. A frame member is provided having a valve assembly mounted thereon with a plurality of valves or valve spools. A shaft is mounted to the frame member, which has an equal plurality of motion transfer devices such as bellcranks or levers mounted thereon. Each of the bellcranks or other connection means is connected, at one connection point, through a link, to an associated valve or valve spool. Another connection point may be connected, through a connecting means, with an adapter mounted to a spherical pivot. A control lever is welded, or otherwise mounted to the adapter, for reciprocation along two axes in an orthogonal relationship, as well as for a twisting motion. Operation of the control lever will cause a transfer of motion from the control lever, through the adapter and connection means, to the motion transfer device, and from there, through connecting links to the valve spools.

In one embodiment of the invention, the valves are randomly oriented in a valve assembly, and the associated bellcranks, levers, and links are of variable length to cause operation of the valves. The connecting means between the other end of the bellcranks and/or levers and the adapter may be of a fixed length, and somewhat flexible in nature.

In another modification of the present invention, valve spools are arranged in a valve housing, and the connecting links between the bellcranks and/or levers and the valve spools are of a fixed length. The connecting means connecting the other ends of the respective bellcranks and/or levers to the adapter have ball and socket connections at each end thereof. Thus, the connection means may be rigid, and the necessary control motions still be obtained.

In a further modification of the invention, the valve spools are arranged in the valve assembly in a spaced relationship and arranged in a row parallel to the longitudinal axis of a frame member. A shaft which is parallel to the valve spool orientation is fixed to the frame member, and the bellcranks are mounted thereon. The connecting means, in addition to having the ball and socket connection means at the end thereof, are of adjustable length, so that standard parts can be used, and tolerance stackups can be accommodated.

Thus, one of the objects of the present invention is to provide a single lever control mechanism which can control three separate functions with different movements of the control lever.

A further object of the present invention is to provide a single lever control mechanism of the foregoing nature wherein the twisting of the lever will control the twisting of the part being controlled.

A further object of the present invention is to provide an improved control mechanism for the working blade of a crawler dozen wherein reciprocation of the control lever in a first control direction (fore and aft) will control the lift and lowering of the crawler dozer blade, the reciprocation of the control lever in a second, orthogonal, control direction (left and right) will control the tilt of the crawler dozer blade, and the twisting of the control lever will change the angle of the crawler dozer blade with respect to the longitudinal axis of the crawler dozer.

A still further object of the present invention is to provide a control mechanism of the foregoing nature wherein the twisting of the control lever will control and simulate the angle of the member being controlled.

A still further object of the present invention is to provide a single lever, three function, control mechanism for heavy construction equipment which has provisions for adding control functions, and auxiliary control levers for those functions, easily and inexpensively.

Another object of the present invention is to provide a single lever, three function, control mechanism which is simpler in construction than prior art devices.

A further object of the present invention is to provide a single lever, multiple function, control mechanism for heavy construction equipment which is relatively simple in nature, and inexpensive to manufacture.

Further objects and advantages of the present invention will be apparent from the following description and appended claims, reference being had to the accompanying drawings forming a part of the specification, wherein like reference characters designate corresponding parts in the several views.

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DESCRIPTION OF THE PREFERRED EMBODIMENTS

In its broadest sense, the control mechanism of the present invention is intended for use on any piece of heavy construction equipment having a working part which must be controlled with respect to three functions. The control of such three functions is particularly advantageous when they are combined for control by a single lever which may be reciprocated in a first control direction to control a first function, may be reciprocated in a second, orthogonal, control direction to control a second control function, and may be twisted about an axis to control a third control function.

Figure 1:
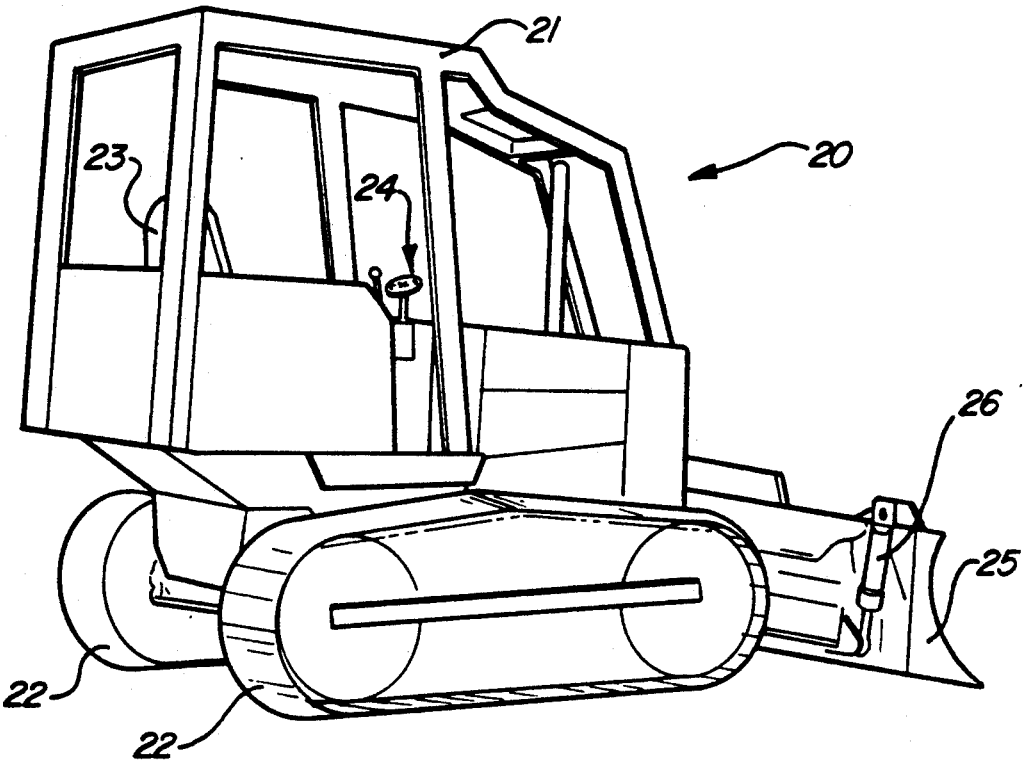
FIG. 1 is a perspective view of a crawler dozer utilizing a control mechanism embodying the construction of the present invention.

FIG. 1 illustrates a piece of heavy construction equipment in the form of a crawler dozer 20 which is propelled for movement along the ground by tracks 22. The crawler dozer 20 has a cab 21 which provides protection for the crawler dozer operator while he is in seat 23.

Figure 2:
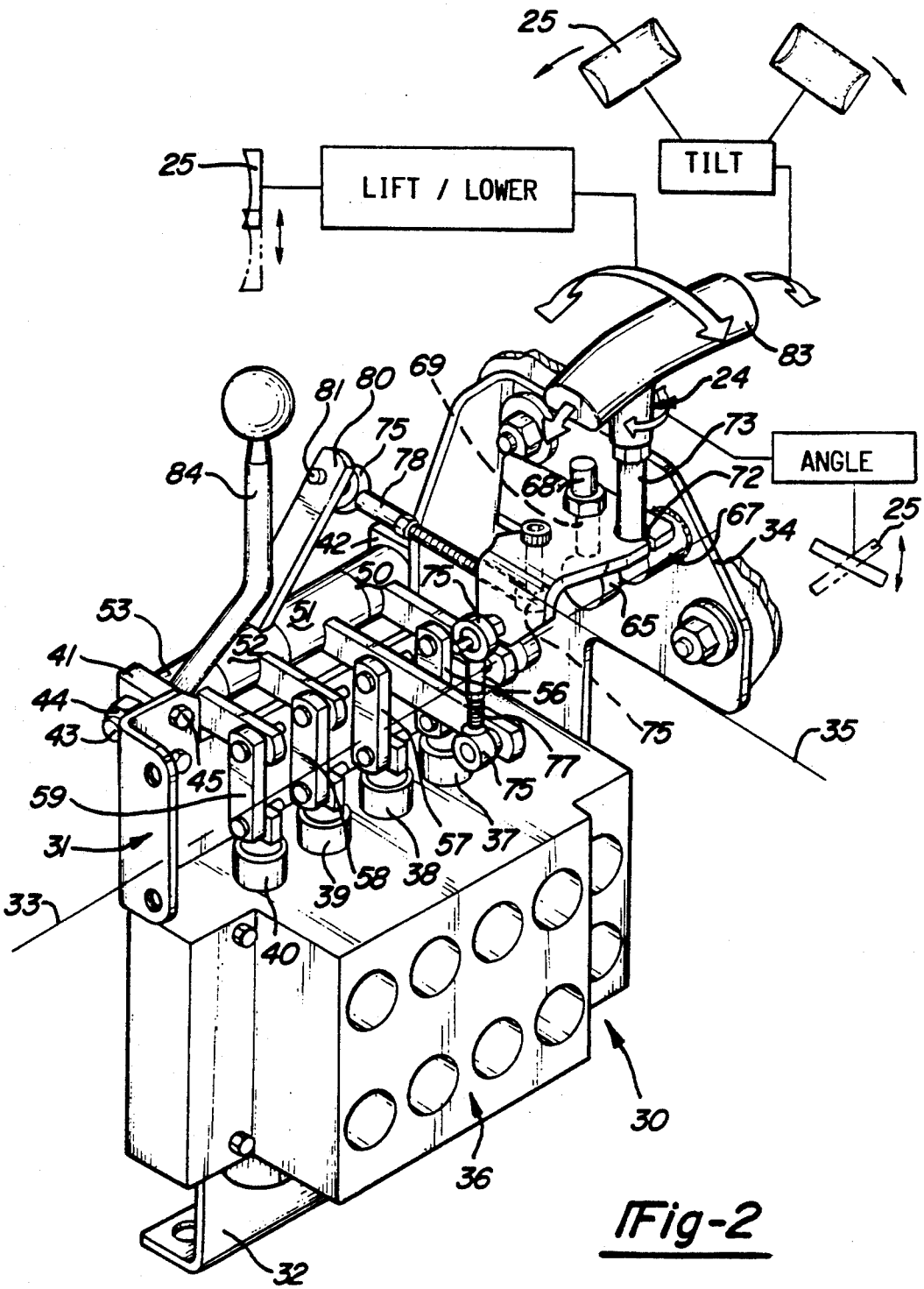
FIG. 2 is a perspective view of a control mechanism embodying the construction of the present invention.

The dozer operator, by operation of control lever 24, controls the position of dozer blade or working part 25. By manipulating the control lever 24 fore and aft in a first control direction, the blade 25 can be lifted or lowered by suitable lifting and lowering means in the form of a hydraulic cylinder (not shown). By manipulating the control lever 24 in a second, orthogonal, control direction, or left and right, the dozer blade or working part 25 can be tilted with respect to a horizontal plane or ground plane passing through the bottom of the tracks 22 (FIG. 2). By twisting the control lever 24 about its axis, the angle of the blade with respect to the longitudinal axis of the crawler dozer can be changed. The more the control lever 24 is twisted, the faster the dozer blade 25 will move.

Twisting the lever past a predetermined angle will allow the operator to control the lifting or lowering function and/or the tilting function at the same time the operator is controlling the angle function, but because of the geometry of the particular mechanism to be described hereinafter, an additional force will preferably be required, which will be translated back to the operator. In this manner the operator will know when these additional functions are being engaged.

Referring now to FIG. 2, there is shown a perspective view of control mechanism 30 embodying the construction of the present invention. A frame member 31 is provided having a lateral wall 32 extending along a transverse axis 33, and a longitudinal wall 34 extending along longitudinal axis 35. It should be understood that the frame member may be made in many sizes and shapes depending on the application, and may, or may not, have both a longitudinal wall and a lateral wall.

Mounted to the frame member 31 is a valve body 36 having a first plurality of valve spools. For example, first valve spool 37, second valve spool 38, third valve spool 39, and fourth valve spool 40. The valve spools are illustrated in spaced relationship, in a row, in the valve body 36 with the row being parallel to transverse axis 33.

Mounted to the lateral wall 32 of the frame member 31 is a first journal 41 which, in combination with the second journal 42, supports shaft 43 on the wall. A nut 44 threaded onto the shaft 43, fixes the shaft in place. Fastening means, such as bolts 45, hold the journals 41, 42 in place on the lateral wall 32.

Figure 3:
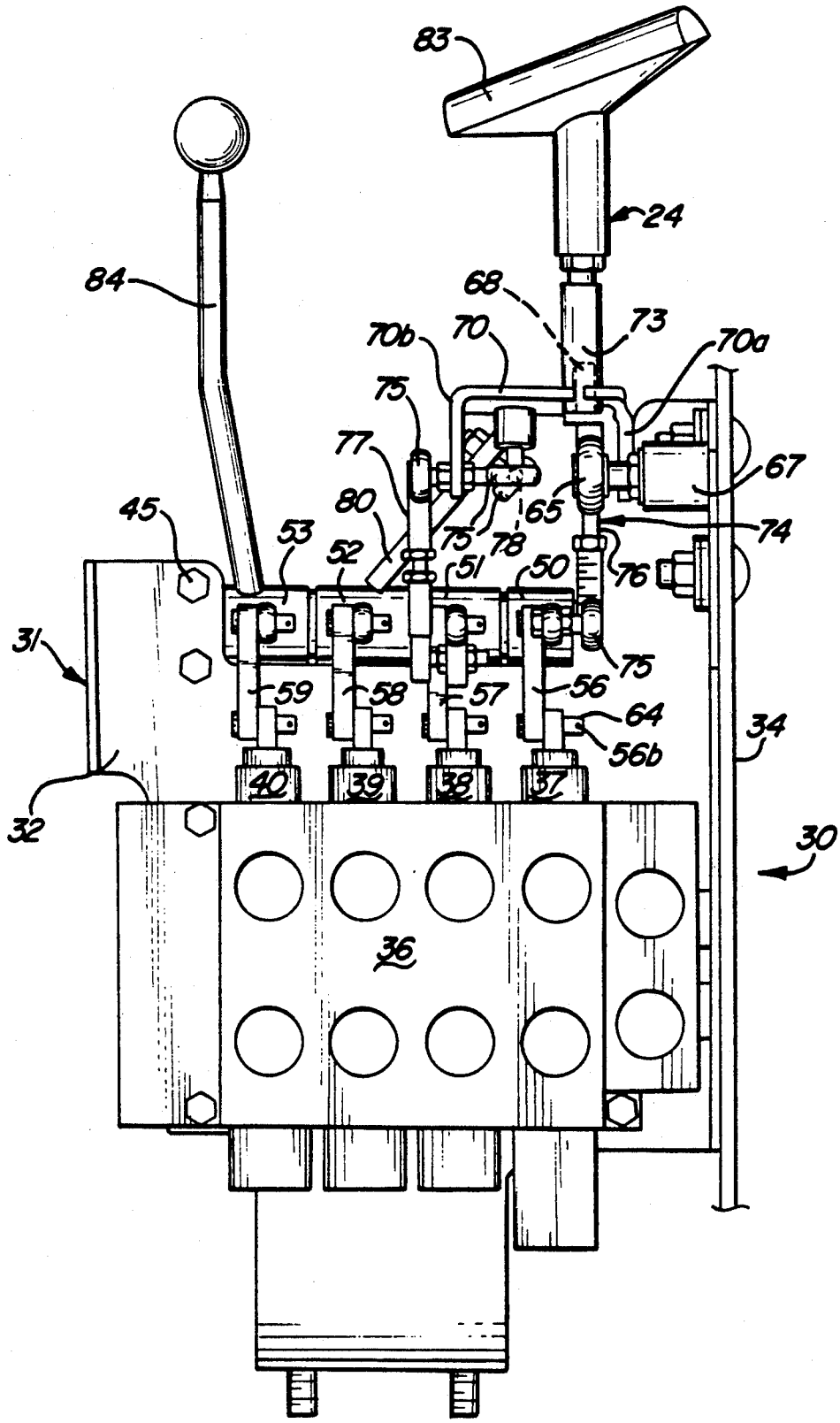
FIG. 3 is an elevational view of the construction shown in FIG. 2.
Figure 4:
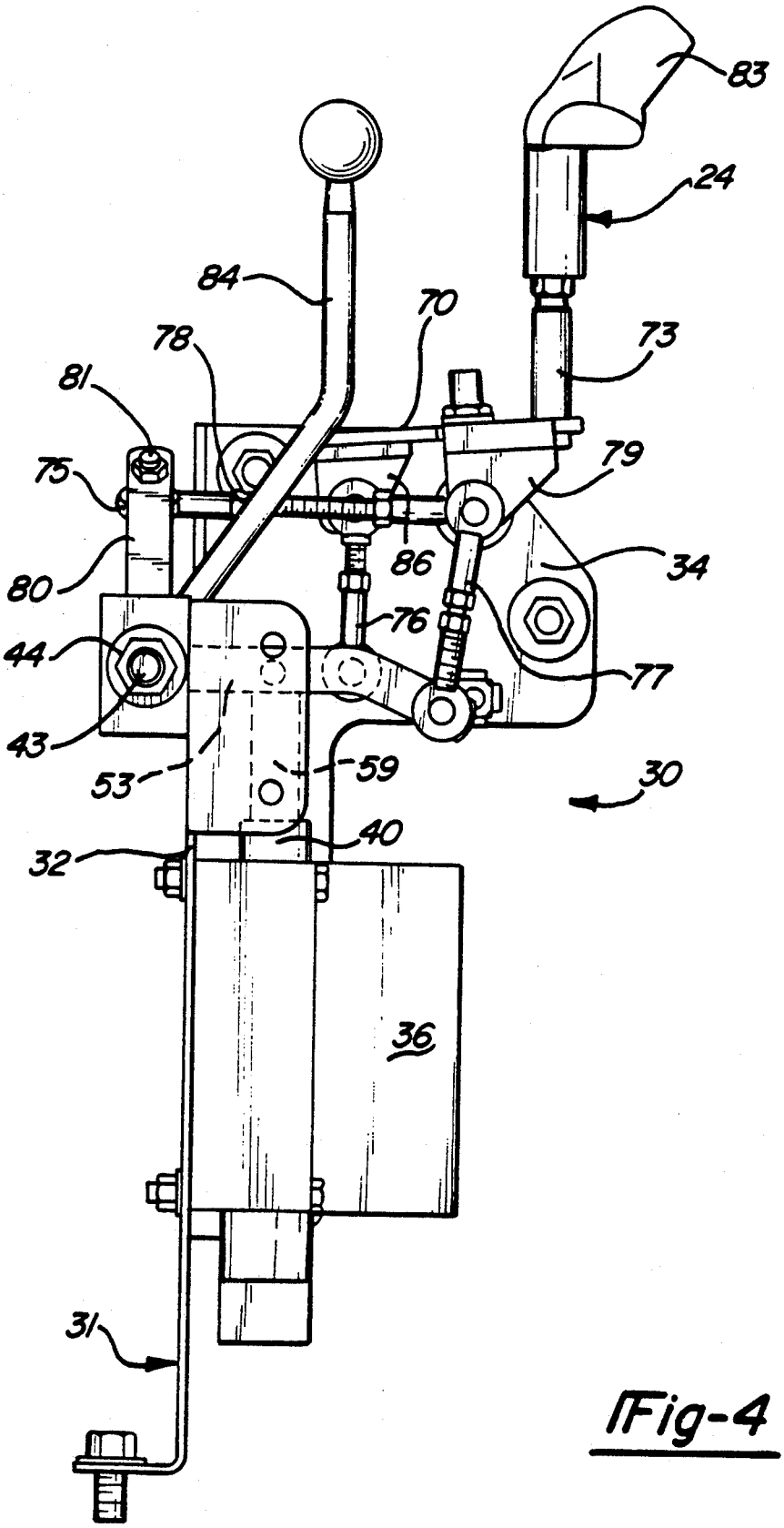
FIG. 4 is a left end view of the construction shown in FIG. 2.

Mounted in series on the shaft 43 (FIGS. 2 and 3) for rotation are an equal plurality of motion transfer devices, such as first lever 50, second lever 51, first generally V-shaped bellcrank 52, and second bellcrank 53. As will be explained, the second bellcrank 53, and other bellcranks, levers, or rocker arms are optional.

First lever 50 is connected to first valve spool 37 by first link 56 using suitable fastening means such as friction fit pins 56A and cotter pins **56*b*. The connection is made between a first connection point on the lever 50 and the valve spool 37. In a similar manner, second lever 51 is connected to second valve spool 38 by means of the second link 57. First bellcrank 52 is connected to third valve spool 39 at one of its ends by third link 58. Second bellcrank 53 is connected to fourth valve spool 40 at one of its ends by fourth link 59**.

While the valve spools 37, 38, 39 and 40 have been shown neatly arranged in a row on the valve body 36, individual valves could also be attached to the frame member 31, depending upon the application of control mechanism 30. Whether individual valves are used, or valve spools in a valve body 36 are used, it is not necessary that they be aligned in a row, as they could be in an offset or other arrangement simply by altering the length and positioning of the respective rocker arms or bellcranks associated with the valves.

Figure 5:
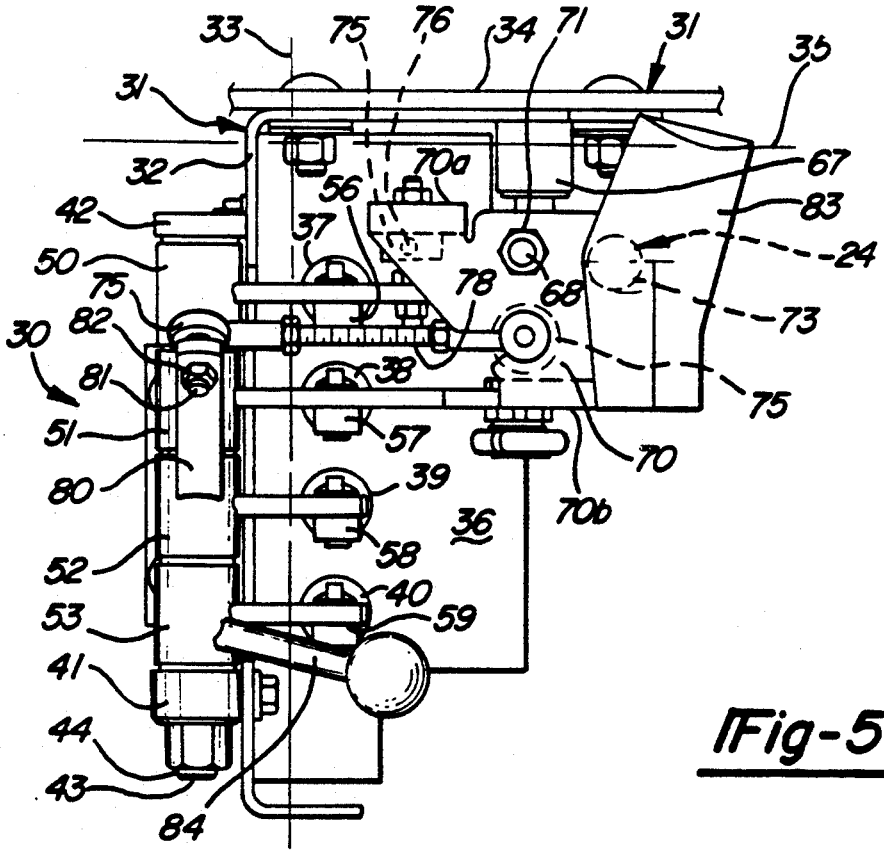
FIG. 5 is a plan view of the construction shown in FIG. 2.

To operate the respective levers and bellcranks, and their associated valve spools, a spherical pivot 65 (FIGS. 2, 3 and 5) is mounted by way of its associated shaft 66 to the mounting cylinder 67 which is fastened to the longitudinal wall 34 of the frame member 31. The spherical pivot 65 has a threaded shaft 68 which passes through a hole 69 (FIG. 2) in an adapter 70. The adapter 70 is affixed to the spherical pivot 65 by the nut 71 (FIG. 5). A hole 72 is provided in the adapter 70 through which the control lever or shaft 73 passes, after which it is welded to the adapter 70.

Movement of the control lever 24 fore and aft, in a first control direction, will cause the adapter 70 to pivot fore and aft about the spherical pivot 65. As shown by the arrows in FIG. 2, movement of the control lever 24 in a left-to-right direction, in a direction preferably orthagonal to the first control direction, which may also be called a second control direction, will cause the adapter 70 to pivot or move left-to-right. Movement of control lever 24 in a third control direction, or a twisting of the control lever 24, will cause the adapter 70 to also twist about the spherical pivot 65.

Integral with the adapter 70 is first tang 70A which extends downwardly from the top surface of the adapter at a 90° angle. A first connection means 74 (FIG. 3) connects tang 70A to a second connection point at the end of first lever 50. Thus, movement of the control lever 24 in a fore and aft, or first control direction, moves the tang 70A in an arcuate path with respect to the spherical pivot 65, and causes the first connection means 74, connecting the adapter to the first rocker arm 50, to move. This causes first link 56 to reciprocate in an up and down direction to operate the first valve spool 37.

The term "connection means" should be interpreted very broadly to mean any connection between the adapter and one of the "motion transfer devices". Such a connection could be a flexible connection if it was of sufficient stiffness to move its associated valve spool. If a stiff connection means is used, it is preferred that a ball and socket connection 75 be provided on each end thereof. In the preferred embodiment of the present invention, the first connection means 74 connecting the adapter 70 to the first rocker arm 50 is in the form of a first variable length link 76.

Connecting a second tang 70B provided on said adapter 70 with the second motion transfer device or second rocker arm 51 is a second variable length link 77 having a ball and socket connection means 75 provided on each end thereof. Each ball and each socket has a threaded connector formed thereon which allows attachment of the ball or the socket, by suitable fastening means, to the desired portion of the control mechanism.

A third motion transfer device, such as first bellcrank 52 is connected to said adapter 70 by a third variable length link 78, having a ball and socket connection 75 provided on each end thereof. An end of the third variable length link 78 is attached to the adapter 70 by one of the ball and socket connections. The ball and socket connection 75 provided at the other end is attached to offset arm 80 of first bellcrank 52. When the control lever 24 is twisted, the adapter 70 will twist about the spherical pivot 65, causing the third variable length link 78 to move the offset arm 80 of the first bellcrank 52 to operate the third valve spool 39 through the third link 58.

The ball and socket connections provide for a limited angular movement of the first, second and third variable length links 76, 77 and 78 respectively. In the preferred embodiment of the invention, the T-shaped handle 83 of the control lever 24 will be able to be twisted about 15 degrees while providing operation of the third valve spool 39. The further the handle 83 is twisted, the faster the blade 25 will move. A release of the handle at any time will cause it to return to center, and the movement of the blade 25 to stop. Thus, placing the handle 83 at an angle will affect the angle of the blade 25. This simulates the movement of the crawler dozer blade 25.

Aspects of the operation of the mechanism 30—specifically, aspects relating to the spherical pivot 65—can be explained in another way. Analogizing, such a pivot 65 has an interior component resembling a sphere (like the earth) with the "poles" lopped off, i.e., a truncated sphere. It also has an external component or "belt" extending around the "equator" and having an interior surface conforming in shape to that of the sphere.

A spherical pivot like pivot 65 permits what is known as "three-axis" freedom of movement. That is, a stem or shaft (like shaft 68) attached to such external component can be moved circumferentially around the equator, tipped toward either pole, twisted on the sphere or all three simultaneously.

Considering FIG. 2, the longitudinal center of shaft 68 (which shaft may be said to be attached to the "belt") extends through the center point of the spherical pivot 65. The long axis of the shaft 73 is parallel to but laterally offset from the center axis of shaft 68. Therefore, all forces applied to the adapter 70 (through manipulation of the handle 83 and lever 24) are applied along what might be termed an offset axis.

When the handle 83 is moved fore or aft (for blade lift/lower), the lever 50 and link 56 move up or down and spool 37 is actuated. However, since the center point of ball-and-socket 75, associated with the upper part of link 77, is substantially coincident with the center axis of cylinder 67 and spherical pivot 65 and since fore and aft handle movement produces only rotation about such center axis (and not tipping), neither socket 75 nor link 77 move up or down. Such up or down movement is necessary to actuate spool 38—which does not occur with only fore/aft handle movement.

The same type of analysis applies with respect to other functions. For example, the angle or "twist" function (represented by the arrow at 24 and the diagrammatic blade 25 in FIG. 2) is controlled by twisting the lever 24/handle 83. The spherical ball-and-socket pivot 75 (shown in dashed outline) which is connected to link 78 is that which operates the twist function and it, too, lies on the center axis of cylinder 67. Assuming only fore/aft handle movement, the Allen head cap screw just below numeral 68 in FIG. 2 tips fore/aft about the spherical pivot 75 shown in dashed outline just below it. Therefore, fore/aft movement alone does not move link 78 and the twist function does not operate. However, twisting the handle 24 causes the adapter plate 70 to rotate about the long axis of shaft 68. As a result, the aforementioned capscrew moves forward or rearward as does link 78 and the twist function is thereby caused to operate. In the analogy set out above and with respect to spherical pivot 65, this is the equivalent of "twisting the belt on the sphere."

The operator may take any appropriate action to control the lift and lower function, or the tilt function, of the blade while continuing to angle the crawler dozer blade.

Thus, the mechanism of the present invention solves long standing problems in the art. It also provides flexibility not found in other controls. While a particular object of the present invention was to combine the three functions as hereinbefore described, it is common for heavy construction equipment to have auxiliary devices which are also operated by hydraulic means. The present control mechanism provides a way to easily add additional valve spools such as fourth valve spool 40, with its associated fourth motion transfer device, such as second bellcrank 53, including auxiliary lever 84, to provide for the operation of auxiliary hydraulic equipment simply by providing a longer valve body 36 having additional valve spools, and providing for a longer shaft 43, so additional bellcranks may be provided thereon with their associated linkages and auxiliary handles. Any practical number of additional hydraulic functions may easily and economically be added to the control unit of the present invention.

Thus, by analyzing problems longstanding in the art, and developing a new approach to solving the same, a novel single lever, three function, controller is provided which provides control movements proportional to actual movements of the working parts being controlled for all three functions, and additionally provides an easy way to add the necessary control elements for additional control functions in an economical fashion.

I claim:

1. A control mechanism including:

a single lever rigidly attached to an adapter plate supported on a spherical pivot for three-axis movement to control three actuators comprising first, second and third function actuators, each actuator being linked to the plate;

the adapter plate being movable in a first, a second and a third control direction to control the first, the second and the third function actuator, respectively;

the third actuator being controlled using a generally V-shaped bellcrank-type lever having one arm coupled to the adapter plate and the other arm coupled to the third actuator, and wherein:

the adapter plate moves when controlling any function actuator.

2. A control mechanism including:

(a) a spherical pivot, (b) an adapter connected to said spherical pivot to permit a control lever affixed to said adapter to be operated in a first control direction, a second control direction, and in a twisting direction, said adapter having a tang extending generally normal thereto;

(c) a plurality of valves, (d) a shaft adjacent to said valves, (e) a separate motion transfer device coupled to each valve, all of the devices being pivotally mounted to said shaft, (f) a first connection means connected between said adapter and a first motion transfer device to operate a first valve when said control lever is moved in the first control direction, (g) a second connection means connected between said adapter tang and a second motion transfer device to operate a second valve when said control lever is operated in the second control direction, and (h) a third connection means connected between said adapter and a third motion transfer device to operate a third valve only when said control lever is twisted, and wherein;

the adapter moves to effect movement of a valve whenever the control lever is moved in any of the three directions.

3. The control mechanism defined in claim 2, wherein the third motion transfer device is a first bellcrank.

4. The control mechanism defined in claim 3, wherein said first bellcrank has an offset arm.

5. The control mechanism defined in claim 4, wherein the valves are in a valve housing and:

(a) said plurality of motion transfer devices include a second bellcrank mounted on said shaft, (b) a fourth valve is provided in said valve housing and is connected to said second bellcrank, and (c) an auxiliary lever forms a portion of said second bellcrank for operation of said fourth valve.

6. In a control mechanism for operating plural hydraulic valve spools using a single handle having freedom of movement in three axes and wherein the longitudinal centerlines of the spools intersect a common axis the improvement wherein:

the mechanism operates three spools;

each of the spools is moved by a separate lever connected by linkage to a common adapter plate;

all levers pivot about a common shaft; and, movement of any lever requires movement of the adapter plate.

7. The control mechanism of claim 6, wherein the shaft is generally parallel to the intersected common axis.

* * * * *